US009660407B2

(12) United States Patent
Chou

(10) Patent No.: US 9,660,407 B2
(45) Date of Patent: May 23, 2017

(54) CRIMP HEAD QUICK-CHANGE STRUCTURE OF A CRIMPING TOOL

(71) Applicant: JETOOL CORP., New Taipei (TW)

(72) Inventor: Chien Hung Chou, New Taipei (TW)

(73) Assignee: JETOOL CORP., New Taipei (TW)

( * ) Notice: Subject to any disclaimer, the term of this patent is extended or adjusted under 35 U.S.C. 154(b) by 329 days.

(21) Appl. No.: 14/640,034

(22) Filed: Mar. 6, 2015

(65) Prior Publication Data

US 2015/0263471 A1 Sep. 17, 2015

(30) Foreign Application Priority Data

Mar. 11, 2014 (TW) ..... 103204091 U

(51) Int. Cl.

| | |
|---|---|
| ***H01R 43/042*** | (2006.01) |
| ***B25B 27/14*** | (2006.01) |
| ***B25B 7/04*** | (2006.01) |
| ***B25B 7/12*** | (2006.01) |
| ***B25B 7/16*** | (2006.01) |

(52) U.S. Cl.

CPC ..... *H01R 43/042* (2013.01); *B25B 7/04* (2013.01); *B25B 7/123* (2013.01); *B25B 7/16* (2013.01); *B25B 27/146* (2013.01)

(58) Field of Classification Search

CPC ..... H01R 43/042; B25B 27/146; B25B 7/04; B25B 7/16; B25B 7/123

See application file for complete search history.

(56) References Cited

U.S. PATENT DOCUMENTS

| | | | | |
|---|---|---|---|---|
| 4,660,241 A * | 4/1987 | Chen | B25B 7/04 | 29/566.4 |
| 7,350,393 B2 * | 4/2008 | Li | B25B 7/04 | 29/751 |
| 8,151,618 B2 * | 4/2012 | Polofsky | B25B 7/04 | 72/409.01 |
| 9,257,806 B2 * | 2/2016 | Lai | H01R 43/042 | 72/409.14 |
| 9,403,264 B2 * | 8/2016 | Hofmann | B25B 7/02 | 81/423 |
| 2009/0308132 A1 * | 12/2009 | Lai | B25B 27/146 | 72/409.16 |

* cited by examiner

*Primary Examiner* — David B Thomas

(74) *Attorney, Agent, or Firm* — Jianq Chyun IP Office

(57) ABSTRACT

This invention is a crimp head quick-change structure of a crimping tool that enables a crimping tool to quickly replace crimp heads of various specifications. The operating theory of the crimp head quick-change structure of a crimping tool is to utilize: a first crimp head protrusion and a first blocker back section notch pushing each other combines with a first crimp head notch and a first head pushing each other to cause the first crimp head to lodge at first clamp section.

6 Claims, 26 Drawing Sheets

CRIMP HEAD QUICK-CHANGE STRUCTURE OF A CRIMPING TOOL

BACKGROUND OF THIS INVENTION

1. Field of this Invention

This invention relates to crimping tools and particularly regards to a crimp head quick-change structure of a crimping tool that enables the replacement of crimp heads with various specifications quickly and conveniently.

2. Description of Related Art

A crimping tool is a tool which creates connections between a terminal and an electrical wire. Prior crimping tool structures all focus on using a notch of a fixed specification at a clamp section where pressure is applied against both a terminal and a wire in order to produce the connection. Due to the fact that the specification of the notch at the clamp section is fixated for a given crimping tool, a separate crimping tool is required for a terminal that has a different specification. Acquiring multiple crimping tools for various terminal dimensions is very costly; moreover, numerous crimping tools can create storage problems and can become very inconvenient.

SUMMARY OF THIS INVENTION

In contrast of the disadvantages of the prior technology, this invention offers a quick-change structure which allows rapid replacement of different crimp heads that are of different specifications.

This invention is a crimp head quick-change structure of a crimping tool that allows the crimping tool to rapidly replace its crimp head. The crimp head quick-change structure of a crimping tool comprises a first clamp handle which is pivotally connected to a second clamp handle, said first clamp handle comprises of: a first clamp section which equips with a first blocker front section and a first blocker back section notch, furthermore, the first blocker front section is setup adjacent to the first blocker back section notch;

said first blocker front section equips with a first fixed section, said first fixed section equips with a first elastic component and a first pusher, said first pusher equips with a first head, said first elastic component pushes said first pusher and causes said first head to protrude outside of said first fixed section;

a first crimp head which equips with a first crimp head protrusion and a first crimp head notch, said first crimp head protrusion is setup adjacent to said first crimp head notch;

therefore, utilizing said first crimp head protrusion and said first blocker back section notch pushing each other combines with said first crimp head notch and said first head pushing each other to cause said first crimp head to lodge at said first clamp section. This is due to the fact that said first head is pushed by said first elastic component, so said first head and said first crimp head notch will push against each other, said first crimp head protrusion and the first blocker back section notch push against each other, as a result, the first crimp head can lodge at the first clamp section. Also, the first crimp head can be extracted from the first clamp section once the aforementioned process is reversed.

Furthermore, said second clamp handle comprises: a second clamp section which equips with a second blocker front section and a second blocker back section notch, said second blocker front section is setup next to said second blocker back section notch;

said second blocker front section equips with a second fixed section, said second fixed section equips with a second elastic component and a second pusher, said second pusher equips with a second head, said second elastic component pushes said second pusher and causes said second head to protrude outside said second fixed section;

a second crimp head equips with a second crimp head protrusion and a second crimp head notch, said second crimp head protrusion is setup next to said second crimp head notch;

therefore, utilizing said second crimp head protrusion and said second blocker back section notch pushing each other combines with said second crimp head notch and said second head pushing each other to cause said second crimp head to lodge at said second clamp section. This is due to the fact that said second head is pushed by said second elastic component, so said second head and said second crimp head notch will push against each other, said second crimp head protrusion and the second blocker back section notch push against each other, as a result, the second crimp head can lodge at the second clamp section. Also, the second crimp head can be extracted from the second clamp section once the aforementioned process is reversed.

Furthermore, said second clamp handle is pivotally connected with a third clamp handle, said third clamp handle is pivotally connected with a fourth clamp handle, said fourth clamp handle is pivotally connected with said first clamp handle;

said first clamp handle equips with a first hook bar, said fourth clamp handle equips with a fourth through hole, one end of a first return spring is attached to said first hook bar, the other end of said first return spring is attached to said fourth through hole.

Furthermore, said fourth clamp handle equips with a ratchet block, said ratchet block equips with a ratchet;

said third clamp handle equips with a first through hole, a third through hole, a second return spring, and a third return spring, one end of said second return spring attaches to said third clamp handle while the other end of said second return spring attaches to a fifth through hole of a rotation section, said rotation section is supported by said third return spring, said rotation section equips with a second through hole and a locking part, said locking part is setup adjacent to said second through hole;

a push button which equips with a top section and a bottom section, said bottom section is setup adjacent to said top section, an annular groove is setup at said bottom section, said bottom section passes through said first through hole, then passes through said second through hole, then further passes said third return spring, after said bottom section passes through said third through hole, said annular groove will extend outside said third clamp handle and a C-ring is then buckled at said annular groove, because frontal projected area of said top section is larger than said frontal projected area of said first through hole, said C-ring enables said push button and said third clamp handle is now rendered to be inseparable;

therefore, when said crimping tool is abnormally locked up, depresses said push button and causes said push button to displace forward, said top section of said push button pushes said rotation section to compress said third return spring, said locking part will now displace forward and situate at different plane relative to said ratchet and will un-mesh with said ratchet, resulting in releasing said locked up crimping tool. This is due to the fact that when said crimping tool is abnormally locked up, said ratchet and said locking parts are meshed together, said crimping tool is no longer operable. Resetting said crimping tool is done by depressing said push button which will now move forward, the top section of said push button will push said rotation section which will compress said third return spring, said locking part will now displace forward and situate at different plane as said ratchet and will un-mesh with said ratchet, resulting in releasing said locked up crimping tool.

When changing crimp head for crimping tools having prior known crimping tool design, a special tool is require to release and tighten a locking screw, however, the design provided by this invention only requires a simple extract and insert of a crimp head without special tool during crimp head replacement, this design provides obvious technical improvement and produces better results, this invention is therefore satisfies all patent requirement.

The above and other objects, features and advantages of this invention will become apparent from the following detailed description taken with the accompanying drawings.

DETAILED DESCRIPTION OF THIS INVENTION

Figure 1:
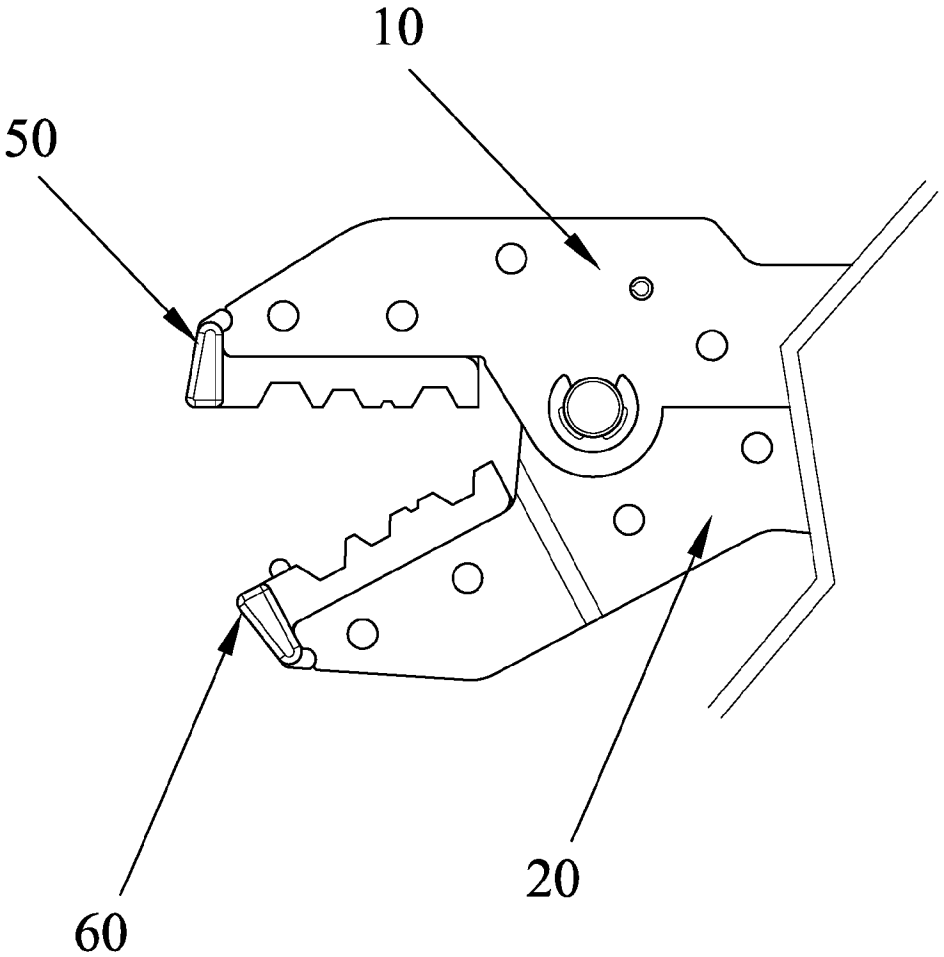
FIG. 1: Front view of partial crimping tool.
Figure 2:
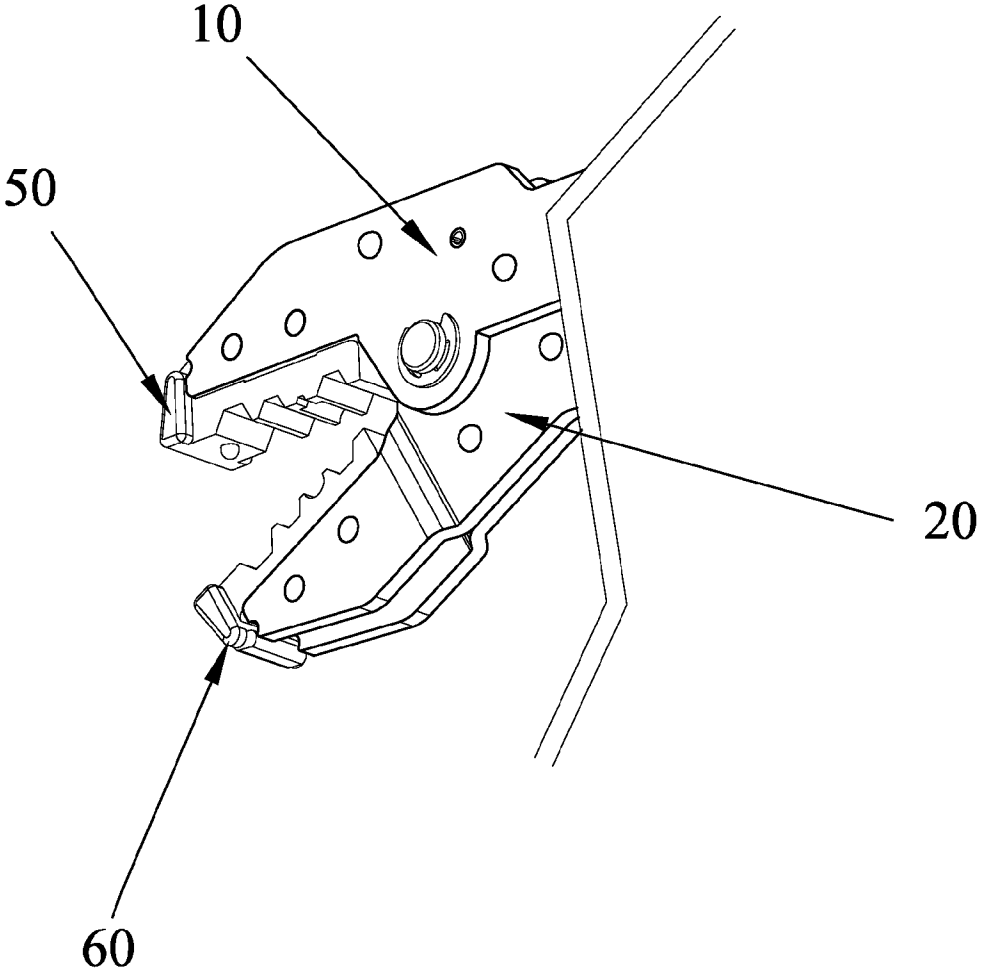
FIG. 2: 3D view of partial crimping tool.
Figure 3:
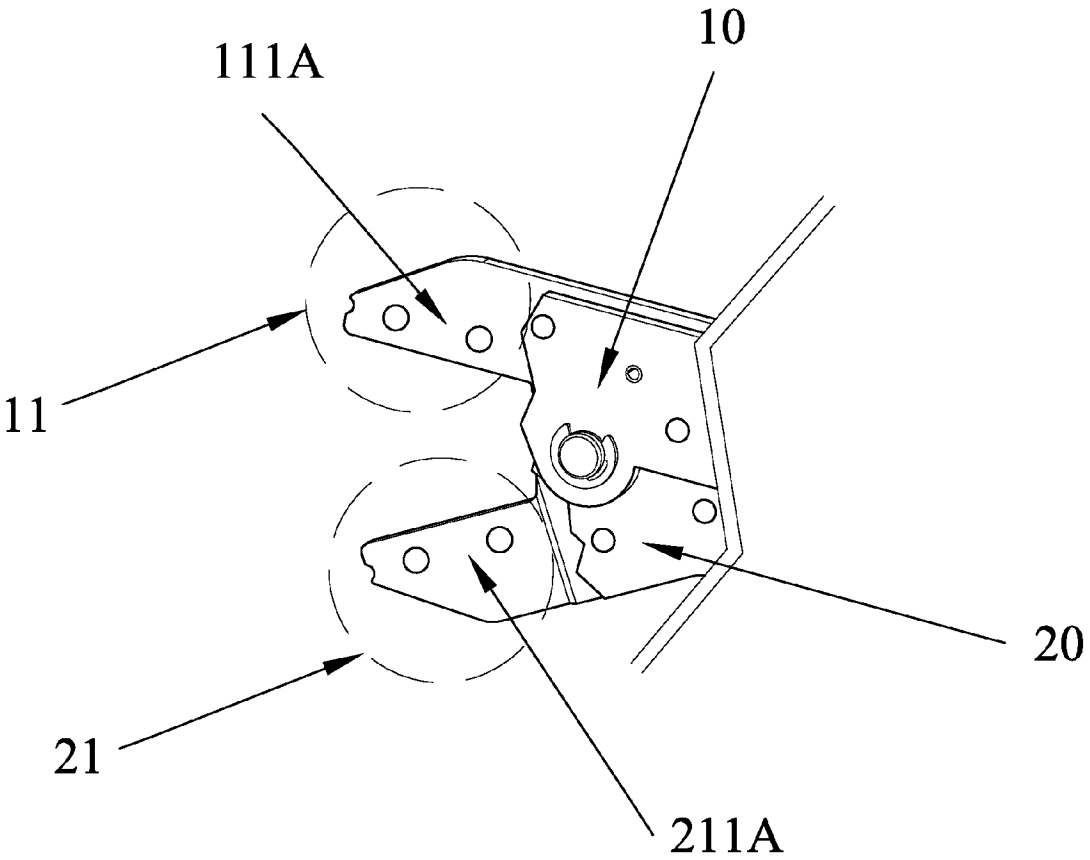
FIG. 3: 3D view of partial crimping tool.
Figure 4:
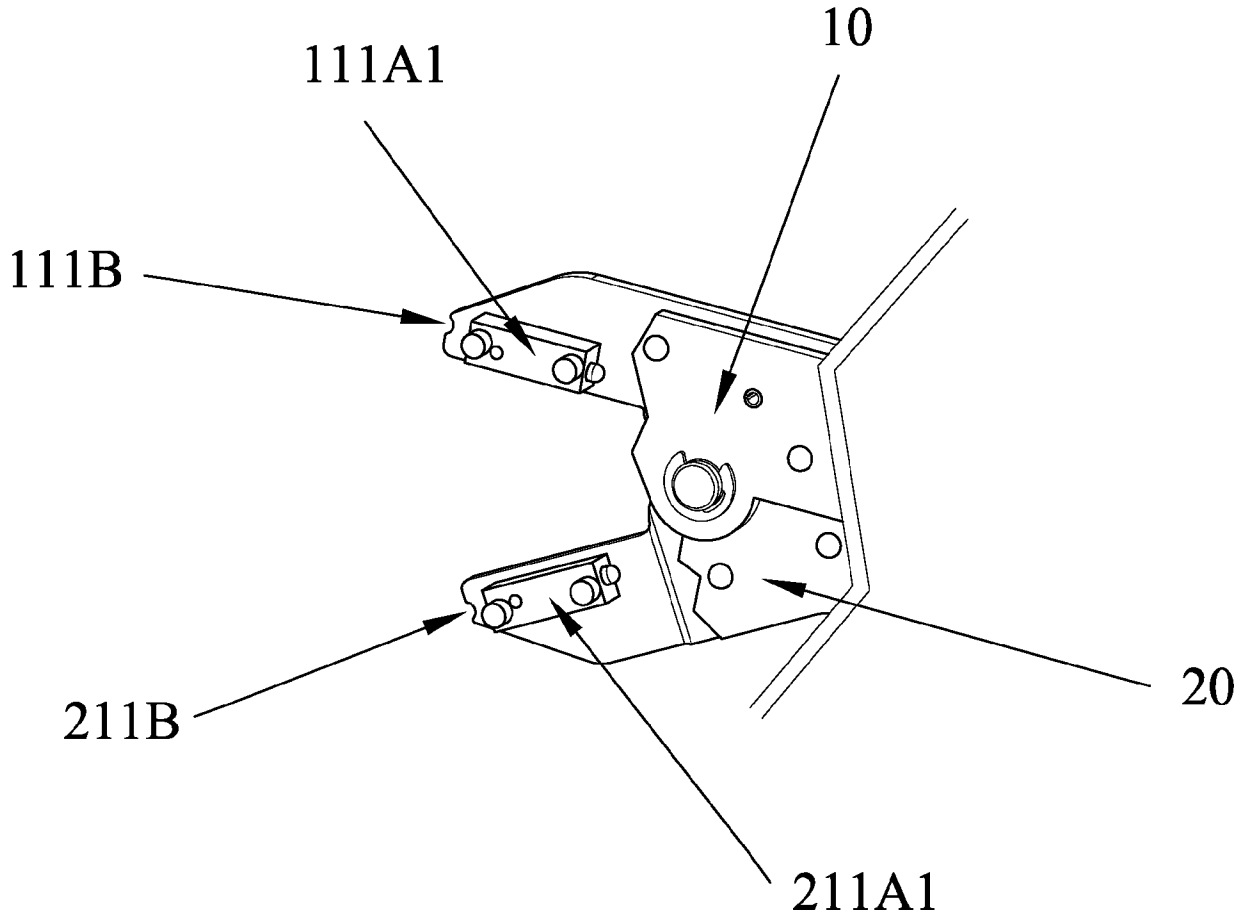
FIG. 4: 3D view of partial crimping tool.
Figure 5:
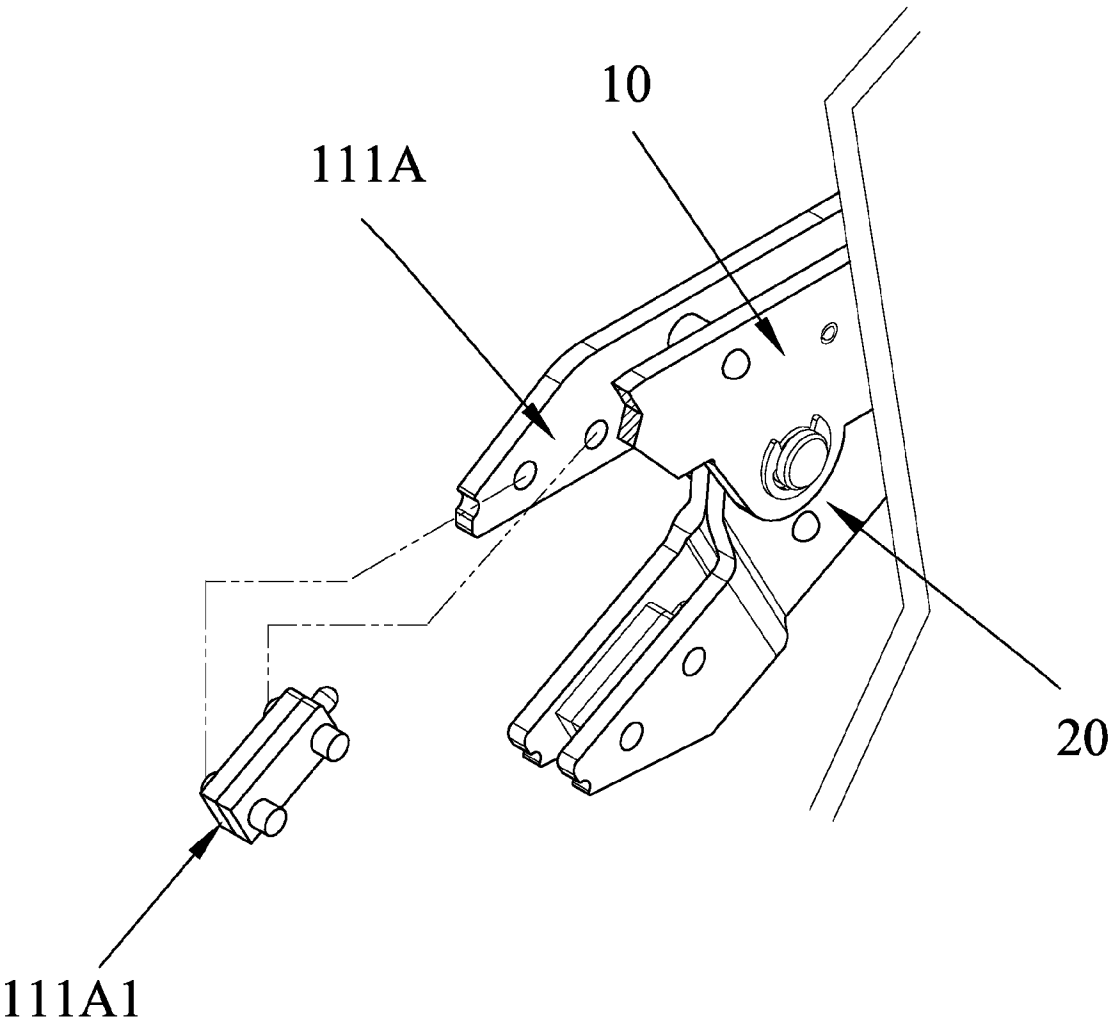
FIG. 5: Perspective view of partial crimping tool.
Figure 5A:
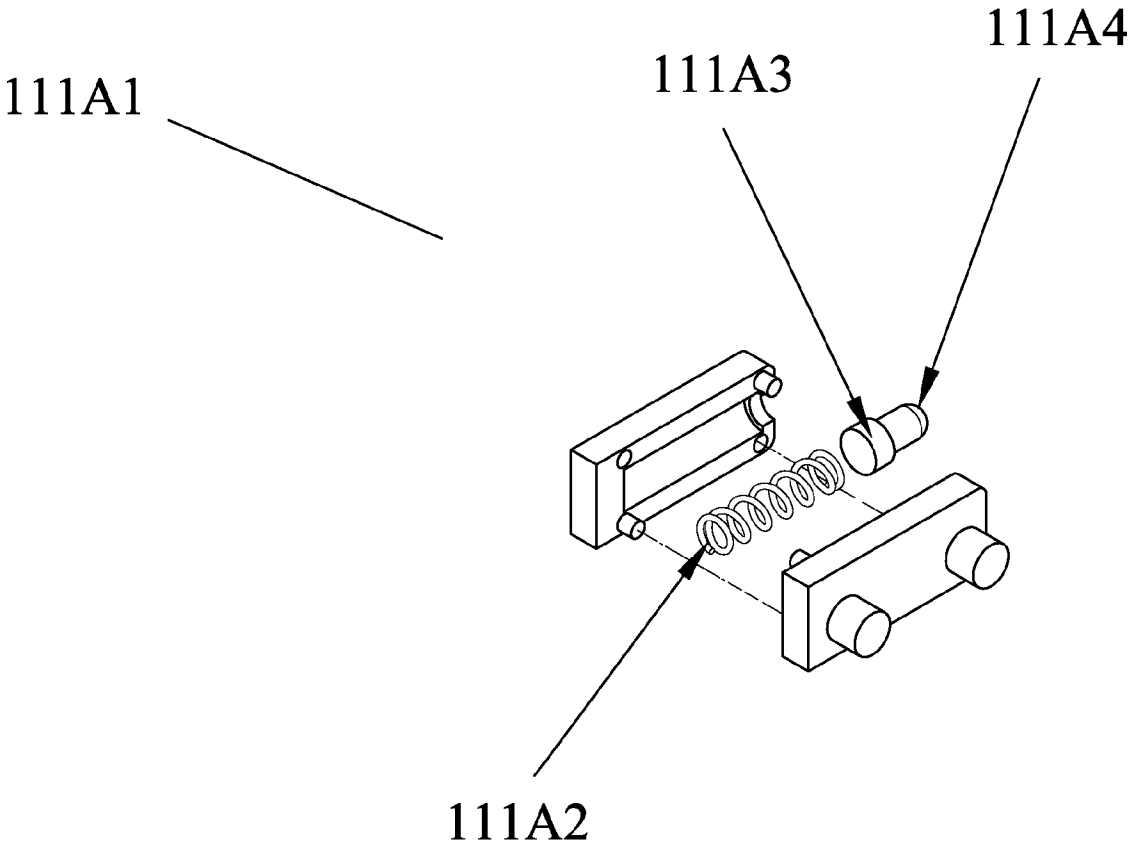
FIG. 5A: First fixed section exploded view.
Figure 6:
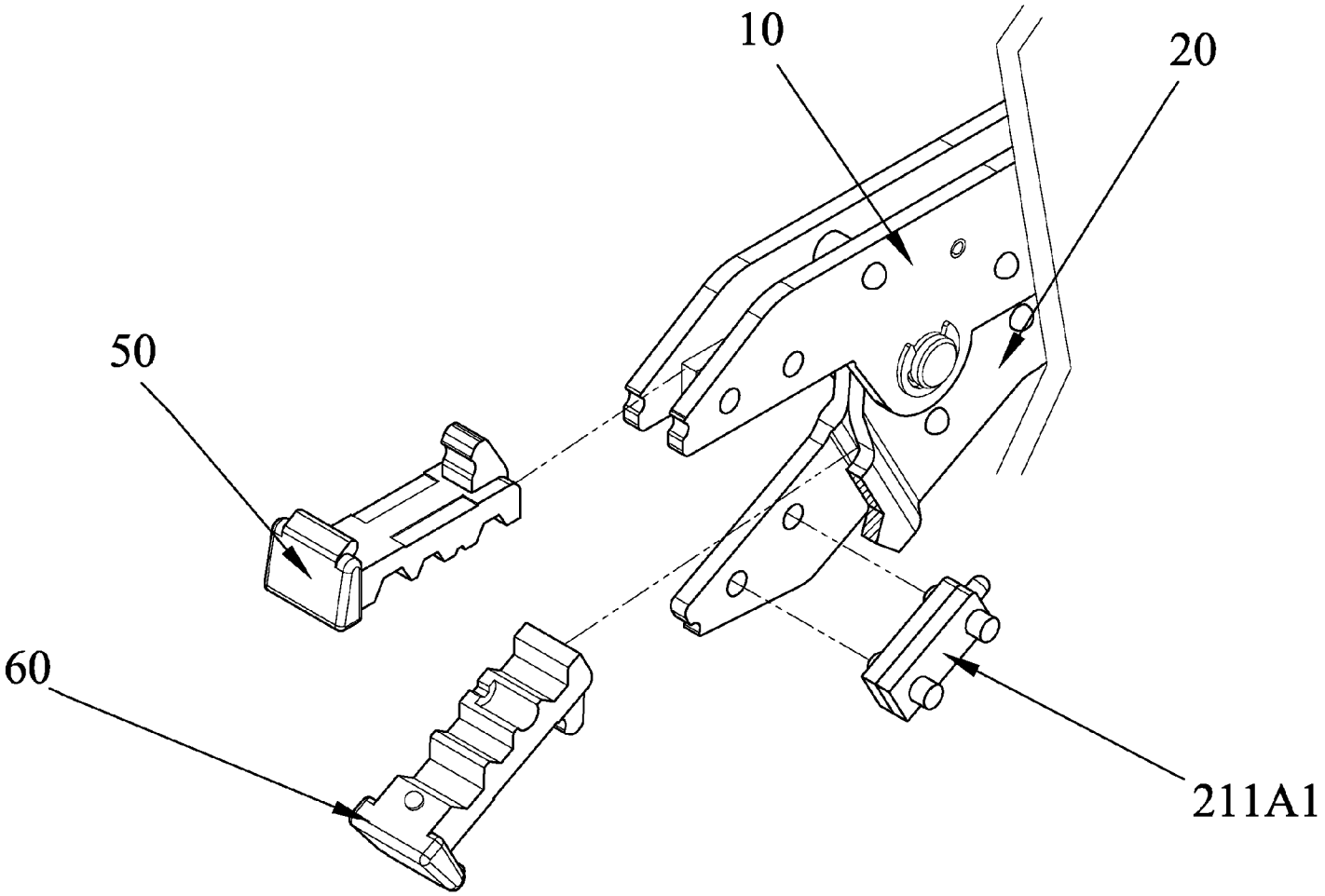
FIG. 6: Perspective view of partial crimping tool.
Figure 6A:
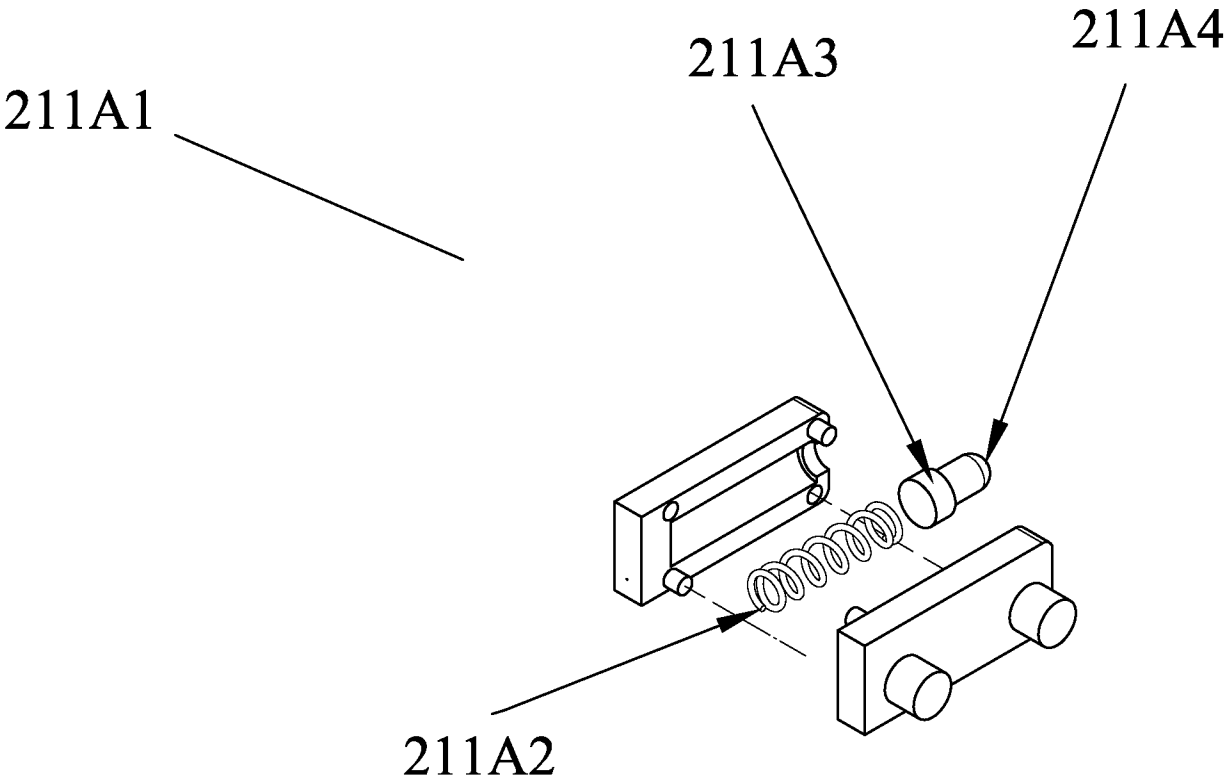
FIG. 6A: Second fixed section exploded view.
Figure 7:
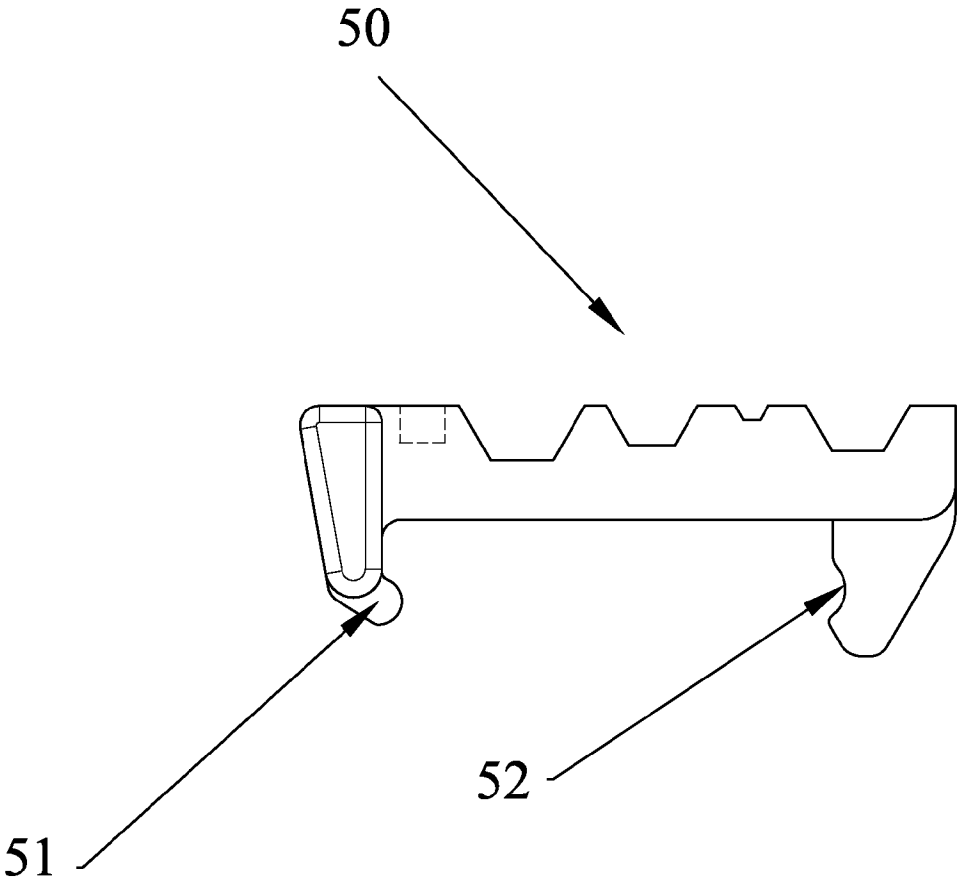
FIG. 7: First crimp head front view.
Figure 8:
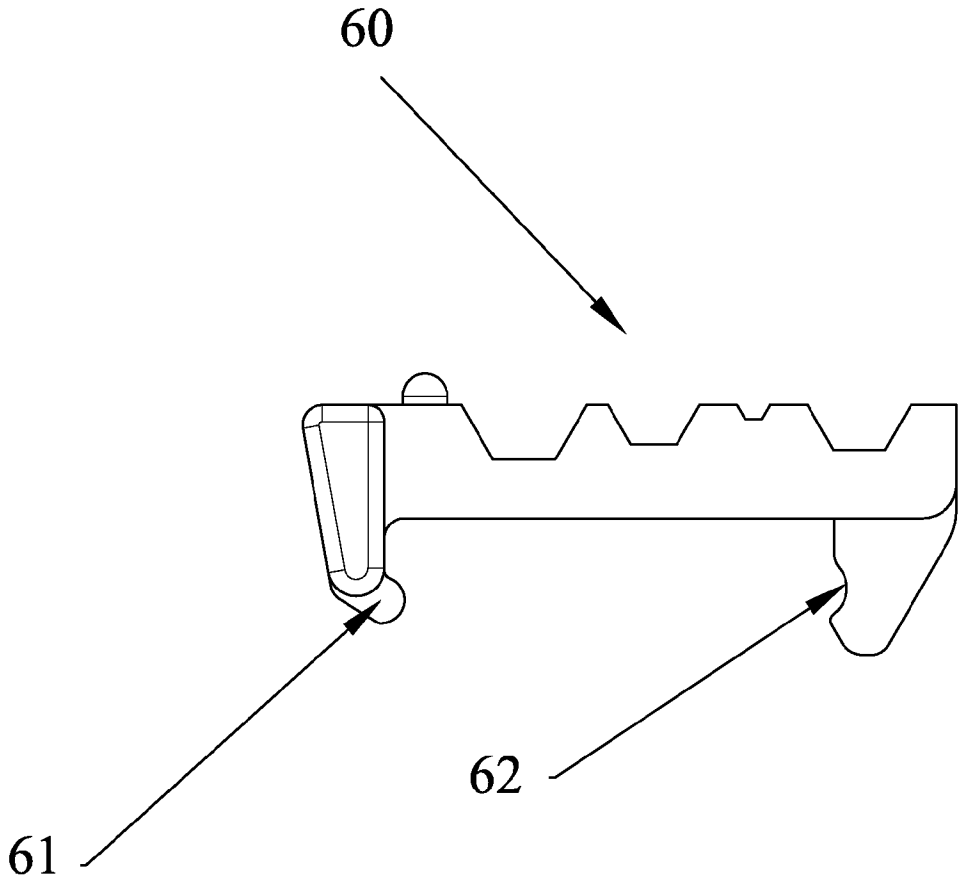
FIG. 8: Second crimp head front view.
Figure 9:
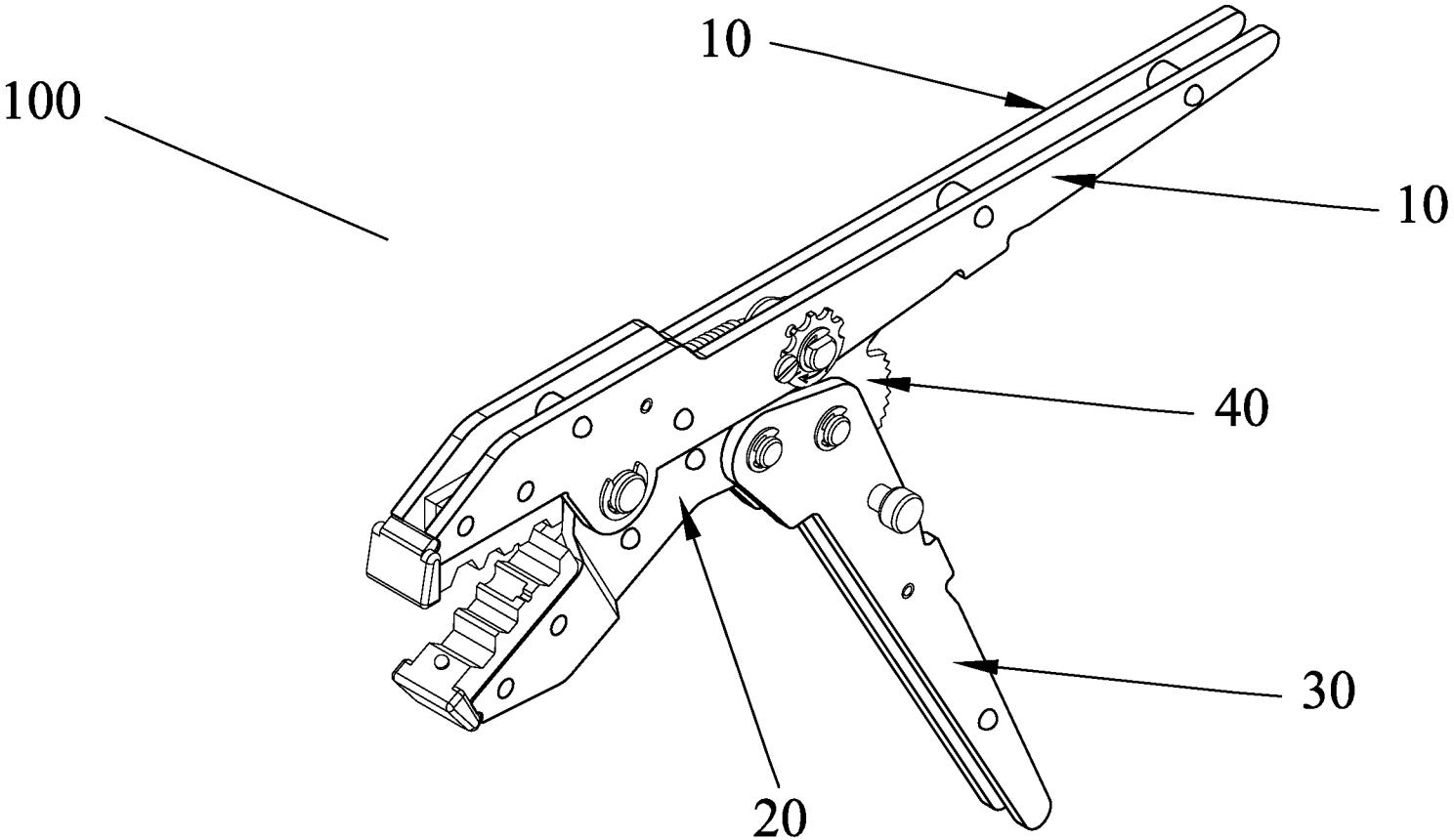
FIG. 9: Crimping tool 3D view.
Figure 10:
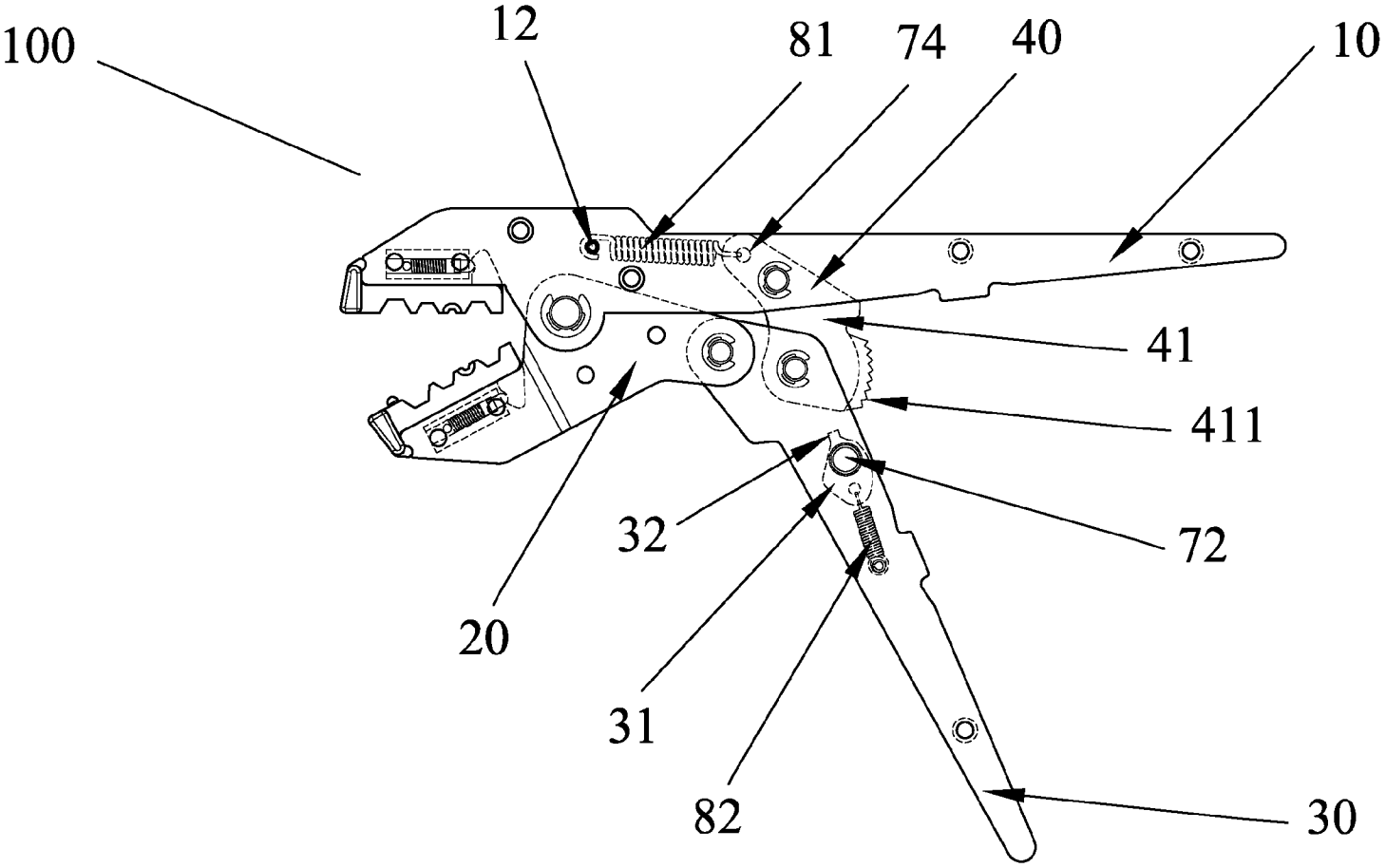
FIG. 10: Composite view of crimping tool having locking part and ratchet disengaged.
Figure 11:
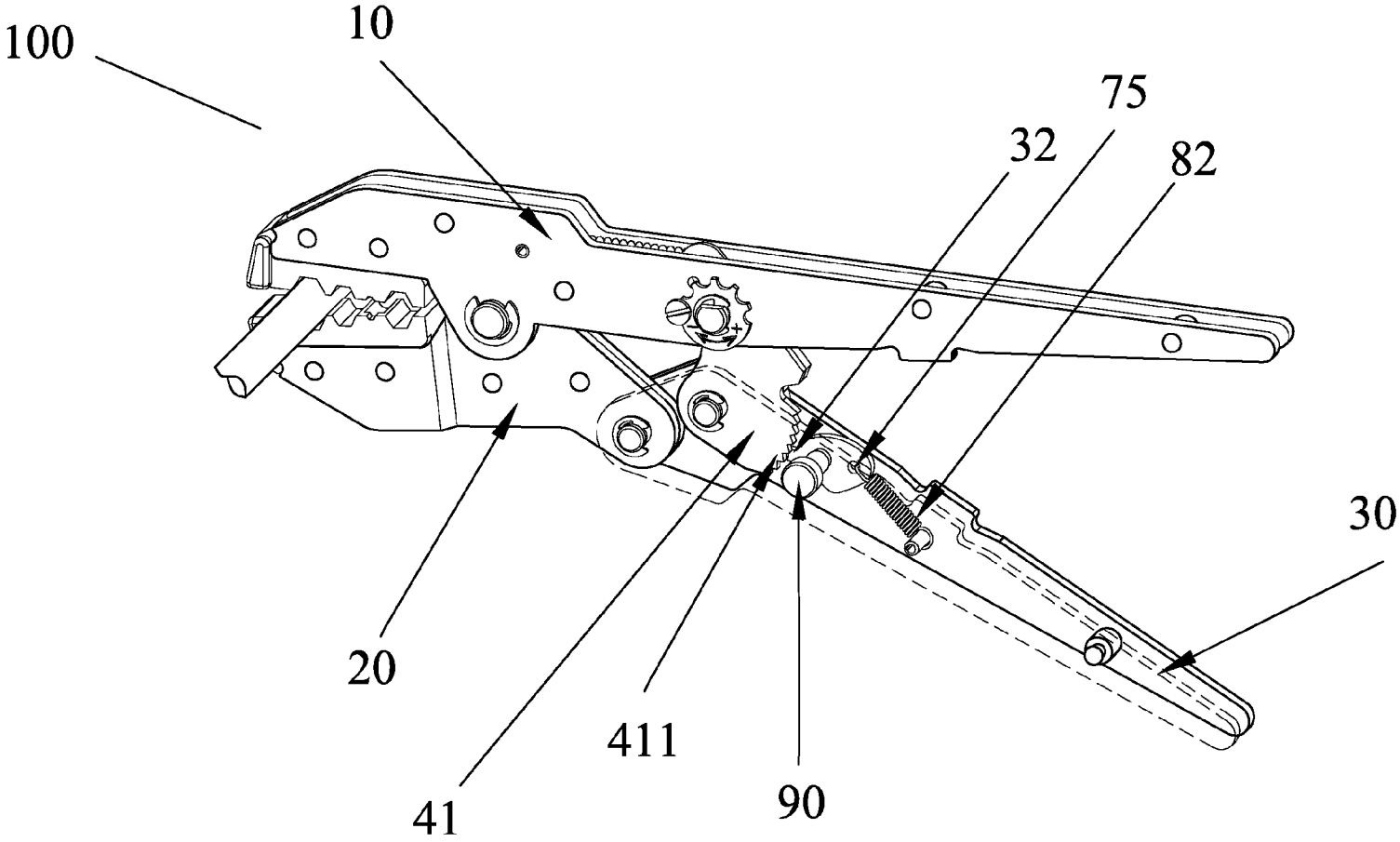
FIG. 11: Crimping tool perspective sectional diagram.
Figure 12:
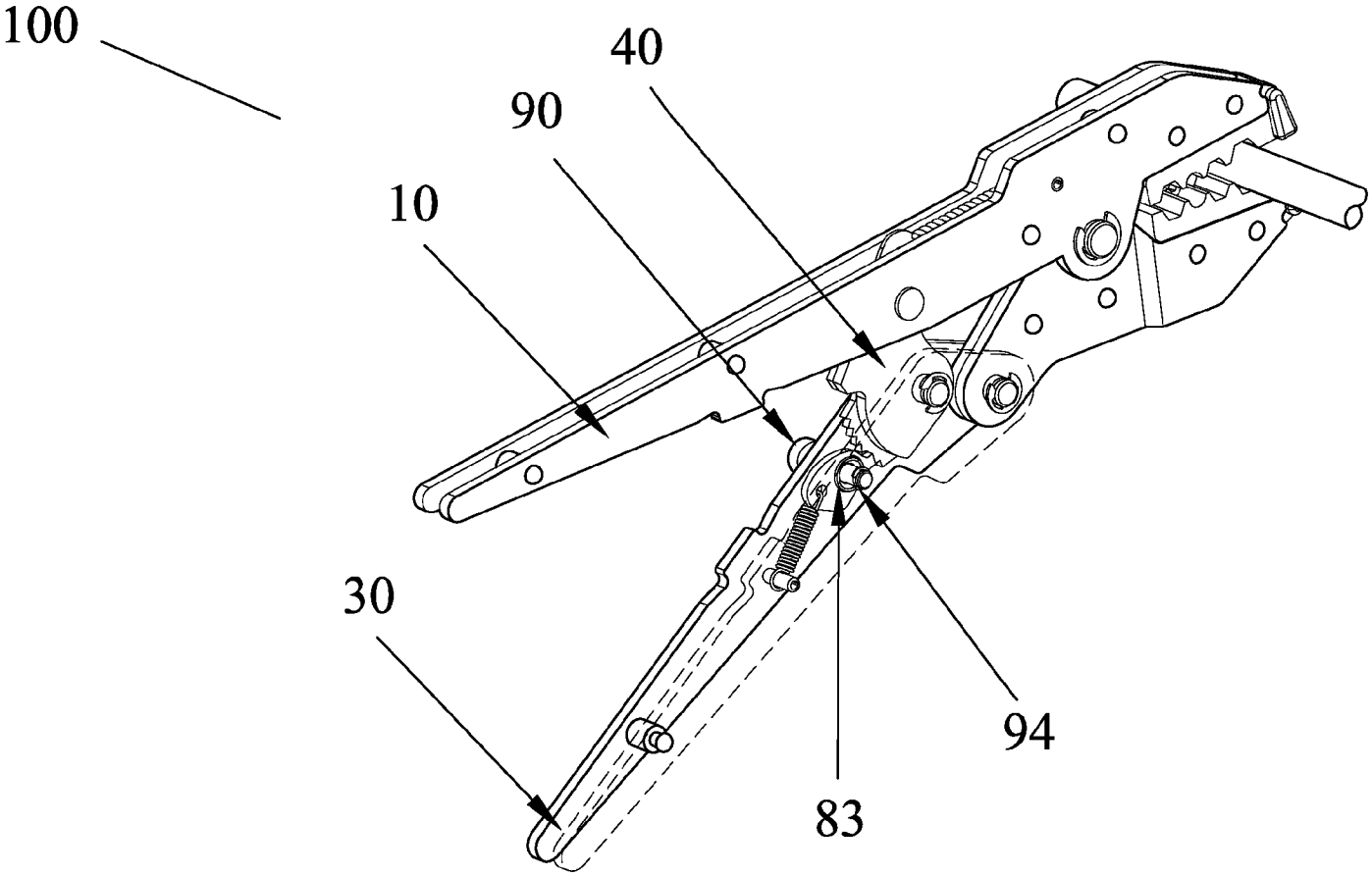
FIG. 12: Crimping tool perspective sectional diagram.
Figure 13:
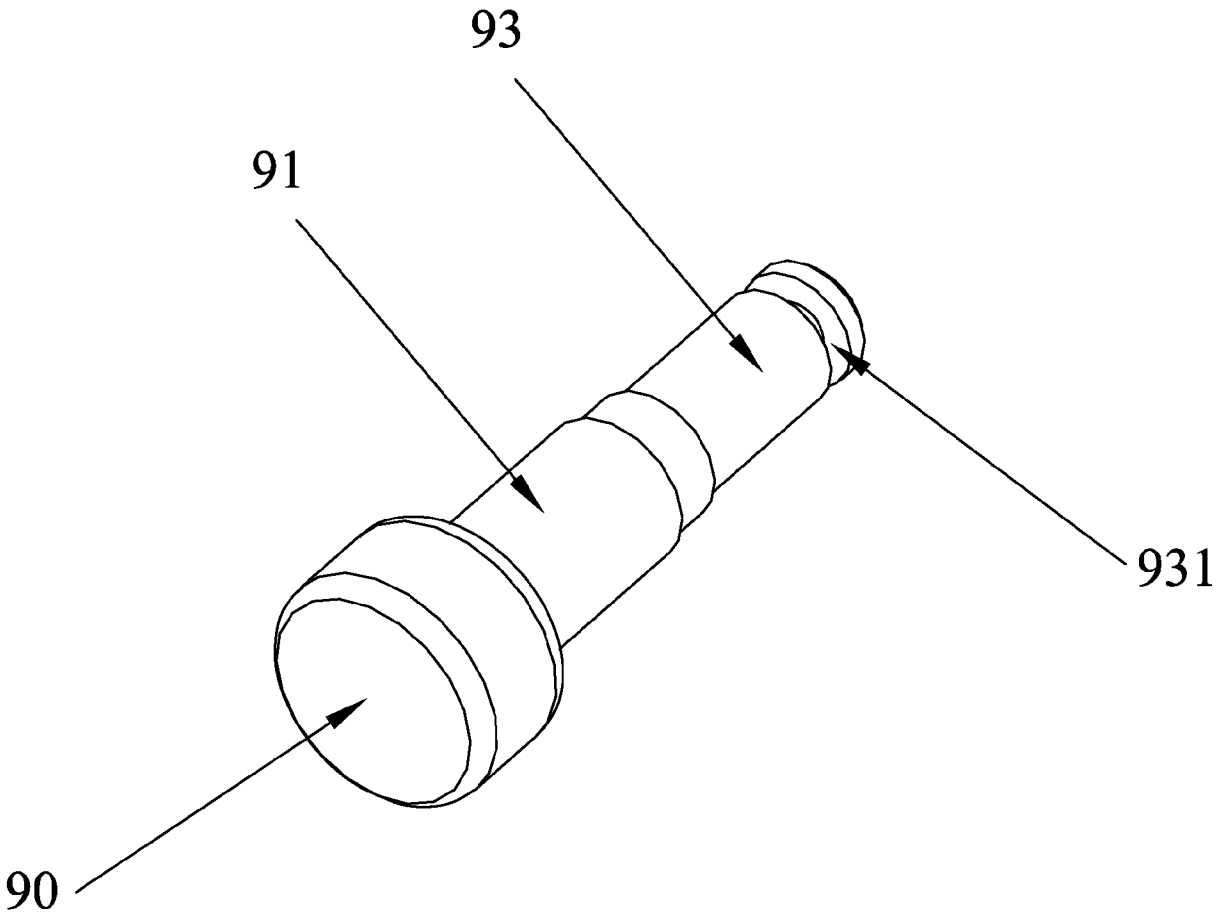
FIG. 13: Push button 3D view.
Figure 14:
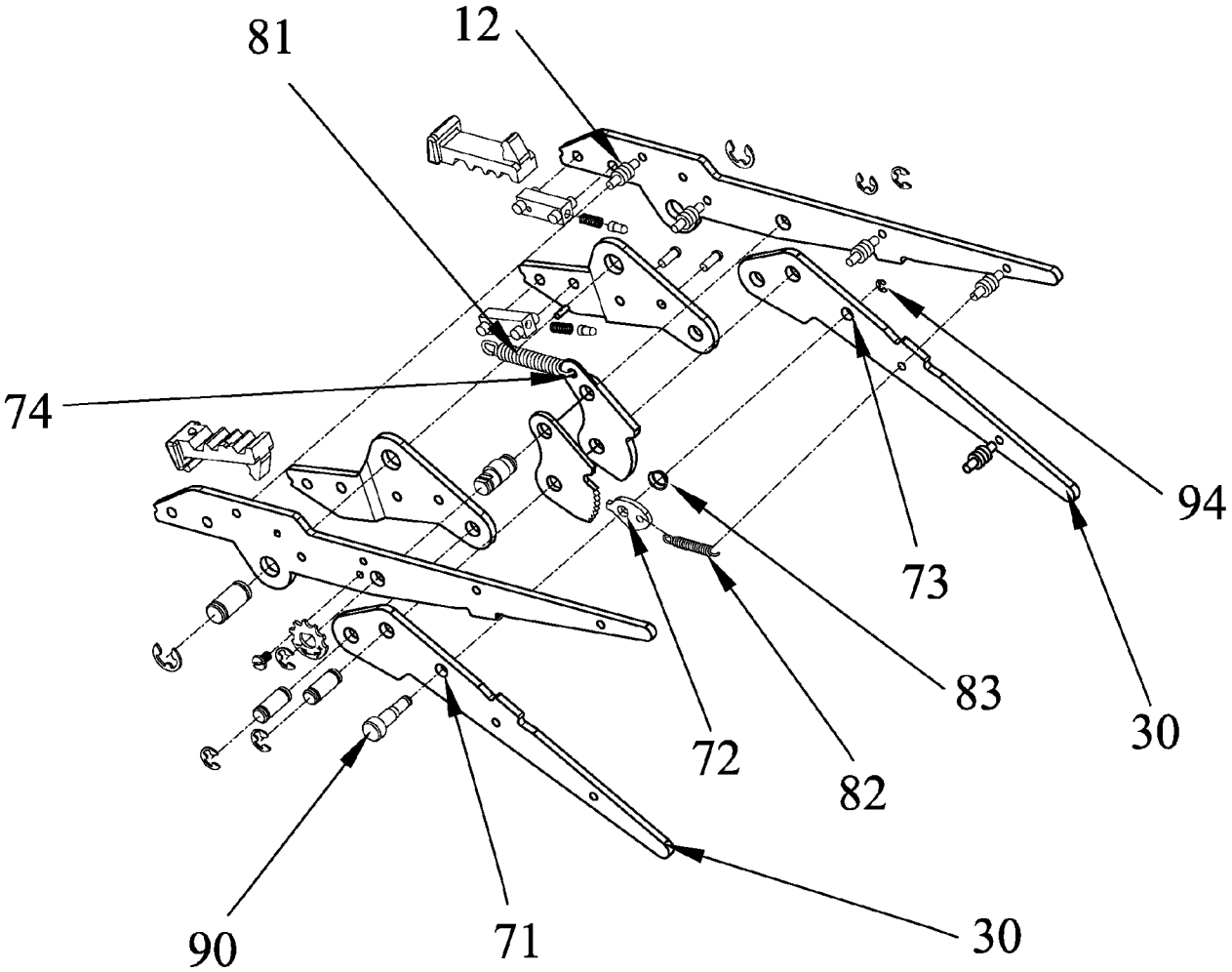
FIG. 14: Crimping tool exploded view.
Figure 15:
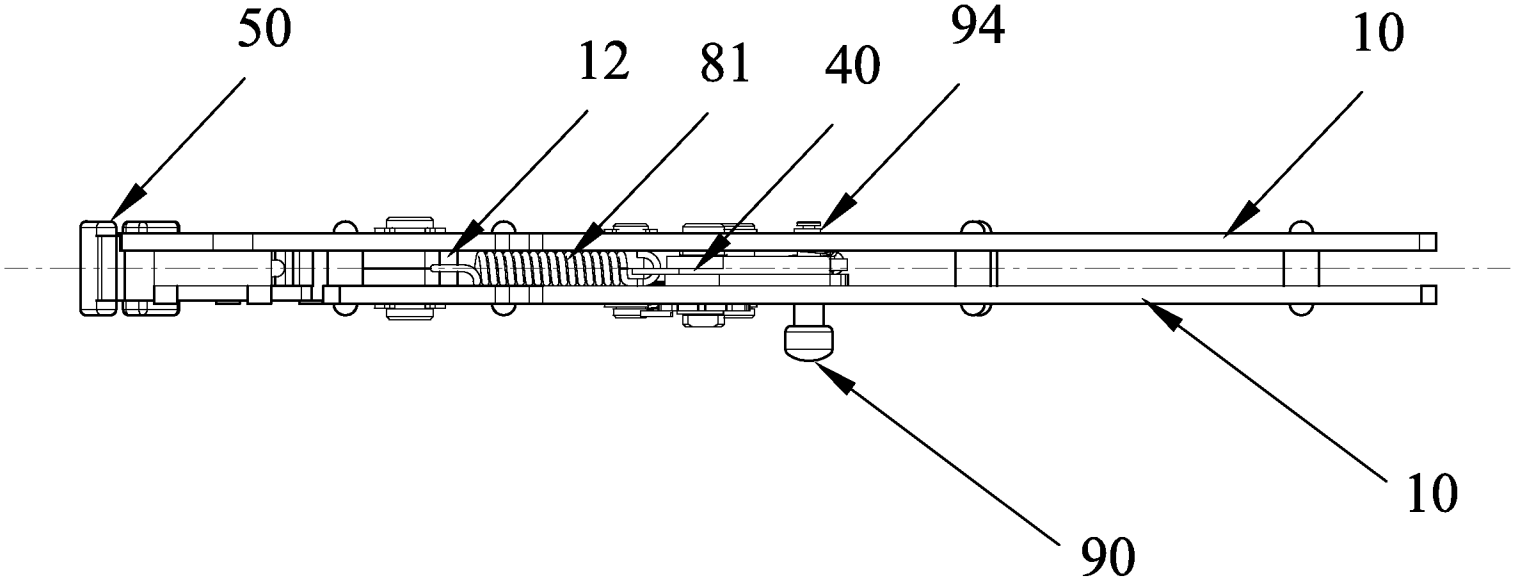
FIG. 15: Crimping tool top view.

With the following specific examples illustrated through the specific embodiment of the present invention, a skilled user of the current technology domain will be able understand the other advantages and effectiveness in which this document reveals. This invention can have additional examples and applications other than what this document already describes; additionally, all details within this document are subject to change according to different viewpoints and applications if and only if the changes are done without deviation from the spirit and principle of this document.

As depicted in FIGS. 1 to 24, this invention is a crimp head quick-change structure of a crimping tool that allows the crimping tool to rapidly replace its crimp head, the crimp head quick-change structure of a crimping tool comprises of: a first clamp handle 10 which is pivotally connected to a second clamp handle 20, said first clamp handle 10 comprises of: a first clamp section 11 which equips with a first blocker front section 111A and a first blocker back section notch 111B, furthermore, the first blocker front section 111A is setup adjacent to the first blocker back section notch 111B;

said first blocker front section 111A equips with a first fixed section 111A1, said first fixed section 111A1 equips with a first elastic component 111A2 and a first pusher 111A3, said first pusher 111A3 equips with a first head 111A4, said first elastic component 111A2 pushes said first pusher 111A3 and causes said first head 111A4 to protrude outside of said first fixed section 111A1;

a first crimp head 50 which equips with a first crimp head protrusion 51 and a first crimp head notch 52, said first crimp head protrusion 51 is setup adjacent to said first crimp head notch 52;

therefore, utilizing said first crimp head protrusion 51 and said first blocker back section notch 111B pushing each other combines with said first crimp head notch 52 and said first head 111A4 pushing each other to cause said first crimp head 50 to lodge at said first clamp section 11.

This is due to the fact that said first head 111A4 is pushed by said first elastic component 111A2, so said first head 111A4 and said first crimp head notch 52 will push against each other, said first crimp head protrusion 51 and the first blocker back section notch 111B push against each other, as a result, the first crimp head 50 can lodge at the first clamp section 11.

Furthermore, said second clamp handle 20 comprises: a second clamp section 21 which equips with a second blocker front section 211A and a second blocker back section notch 211B, said second blocker front section 211A is setup next to said second blocker back section notch 211B;

said second blocker front section 211A equips with a second fixed section 211A1, said second fixed section 211A1 equips with a second elastic component 211A2 and a second pusher 211A3, said second pusher 211A3 equips with a second head 211A4, said second elastic component 211A2 pushes said second pusher 211A3 and causes said second head 211A4 to protrude outside said second fixed section 211A1;

a second crimp head 60 equips with a second crimp head protrusion 61 and a second crimp head notch 62, said second crimp head protrusion 61 is setup next to said second crimp head notch 62;

therefore, utilizing said second crimp head protrusion 61 and said second blocker back section notch 211B pushing each other combines with said second crimp head notch 62 and said second head 211A4 pushing each other to cause said second crimp head 60 to lodge at said second clamp section 21.

This is due to the fact that said second head 211A4 is pushed by said second elastic component 211A2, so said second head 211A4 and said second crimp head notch 62 will push against each other, said second crimp head protrusion 61 and the second blocker back section notch 211B push against each other, as a result, the second crimp head 60 can lodge at the second clamp section 21.

Furthermore, said second clamp handle 20 is pivotally connected with a third clamp handle 30, said third clamp handle 30 is pivotally connected with a fourth clamp handle 40, said fourth clamp handle 40 is pivotally connected with said first clamp handle 10;

said first clamp handle 10 equips with a first hook bar 12, said fourth clamp handle 40 equips with a fourth through hole 74, one end of a first return spring 81 is attached to said first hook bar 12, the other end of said first return spring 81 is attached to said fourth through hole 74.

Furthermore, said fourth clamp handle 40 equips with a ratchet block 41, said ratchet block 41 equips with a ratchet 411;

said third clamp handle 30 equips with a first through hole 71, a third through hole 73, a second return spring 82, and a third return spring 83, one end of said second return spring 82 attaches to said third clamp handle 30 while the other end of said second return spring 82 attaches to a fifth through hole 75 of a rotation section 31, said rotation section 31 is supported by said third return spring 83, said rotation section 31 equips with a second through hole 72 and a locking part 32, said locking part 32 is setup adjacent to said second through hole 72;

a push button 90 which equips with a top section 91 and a bottom section 93, said bottom section 93 is setup adjacent to said top section 91, an annular groove 931 is setup at said bottom section 93, said bottom section 93 passes through said first through hole 71, then passes through said second through hole 72, then further passes said third return spring 83, after said bottom section 93 passes through said third through hole 73, said annular groove 931 will extend outside said third clamp handle 30 and a C-ring 94 is then buckled at said annular groove 931, because frontal projected area of said top section 91 is larger than said frontal projected area of said first through hole 71, said C-ring 94 enables said push button 90 and said third clamp handle 30 is now rendered to be inseparable;

therefore, when said crimping tool 100 is abnormally locked up, depresses said push button 90 and causes said push button 90 to displace forward, said top section 91 of said push button 90 pushes said rotation section 31 to compress said third return spring 83, said locking part 32 will now displace forward and situate at different plane relative to said ratchet 411 and will un-mesh with said ratchet 411, resulting in releasing said locked up crimping tool 100.

Execution of crimp head lock up and extraction (according to FIGS. 16 to 18):

Utilizing said first head 111A4 and said first crimp head notch 52 pushing each other, along with said first crimp head protrusion 51 and the first blocker back section notch 111B pushing each other to cause the first crimp head 50 to lodge at the first clamp section 11.

Figure 16:
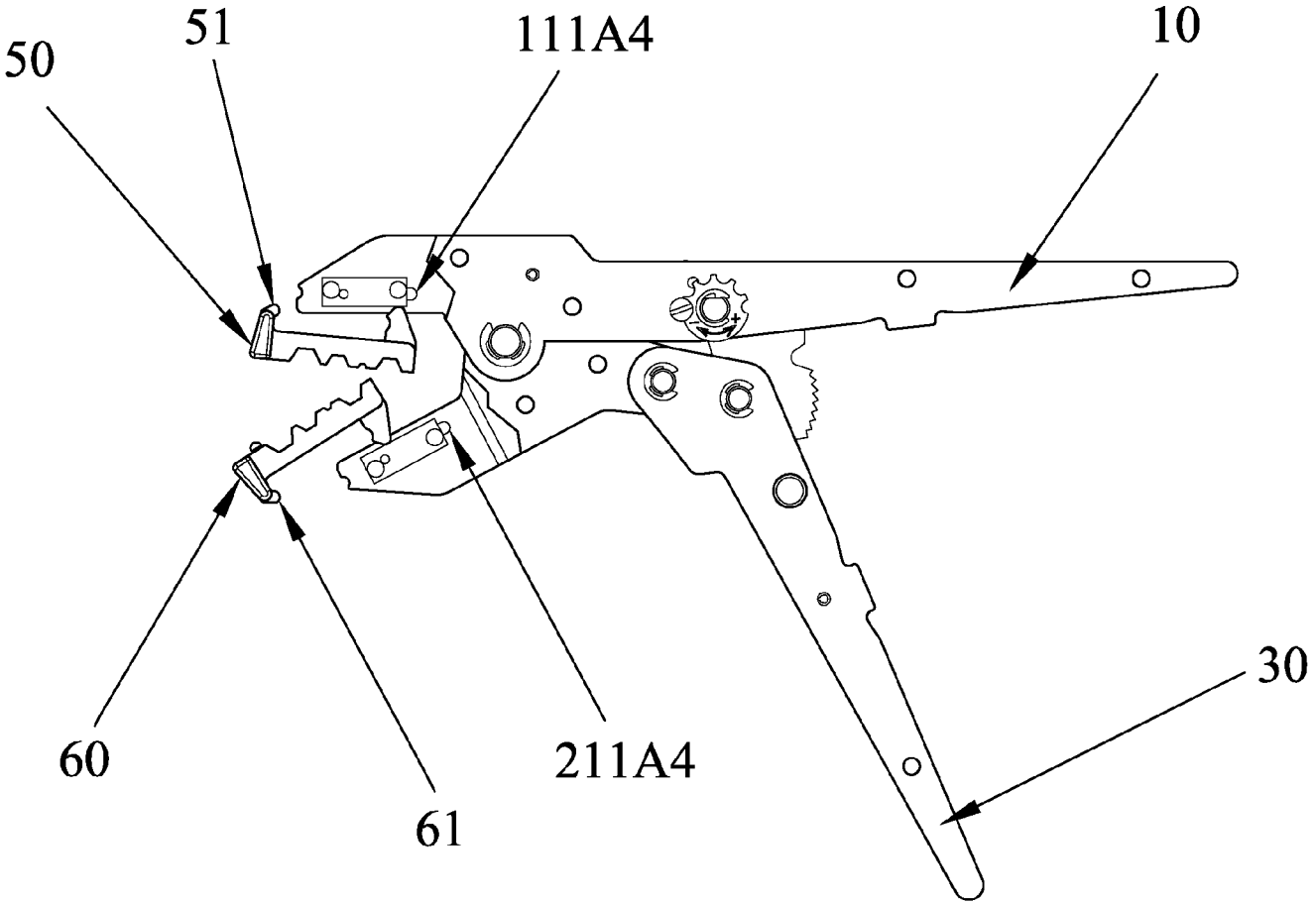
FIG. 16: Crimping tool when crimp head is in place.
Figure 17:
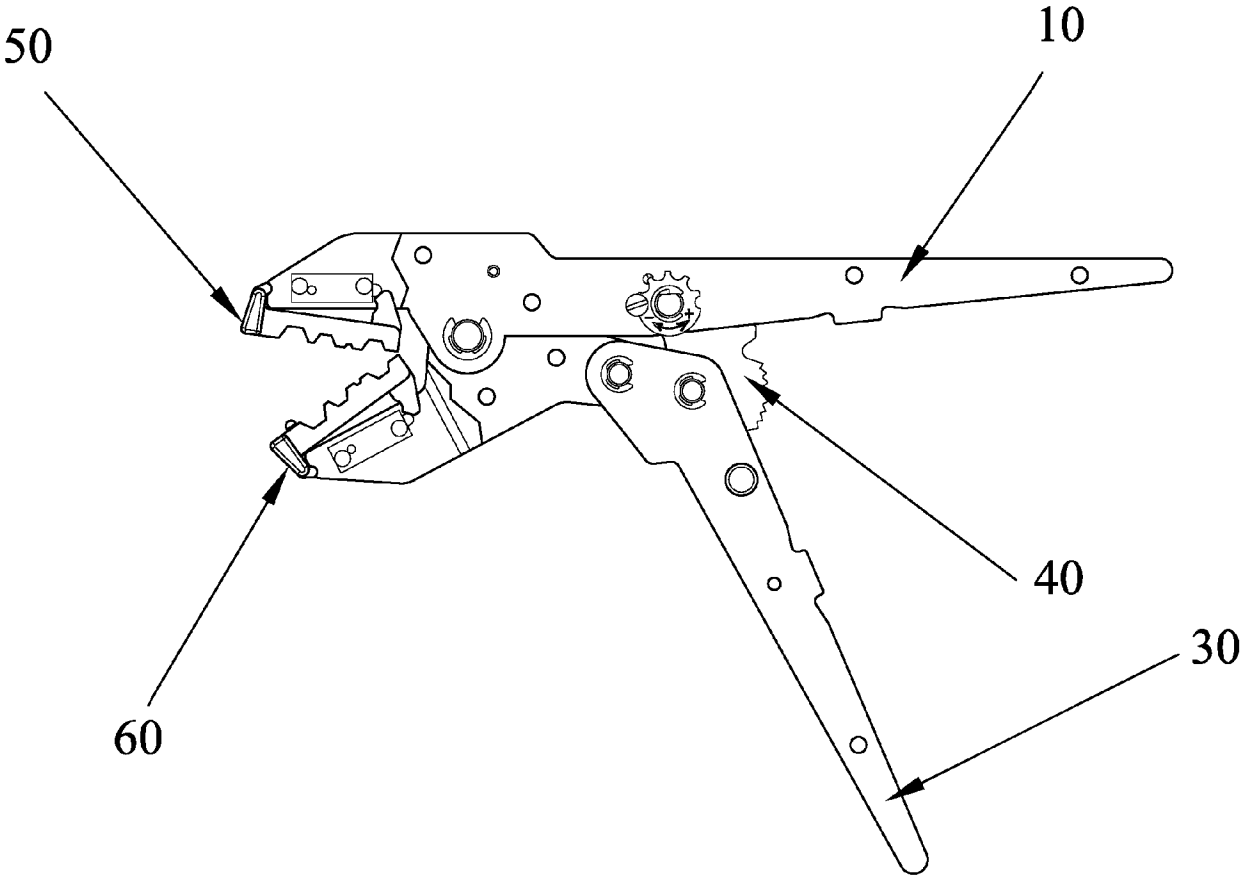
FIG. 17: Crimping tool when crimp head is in place.
Figure 18:
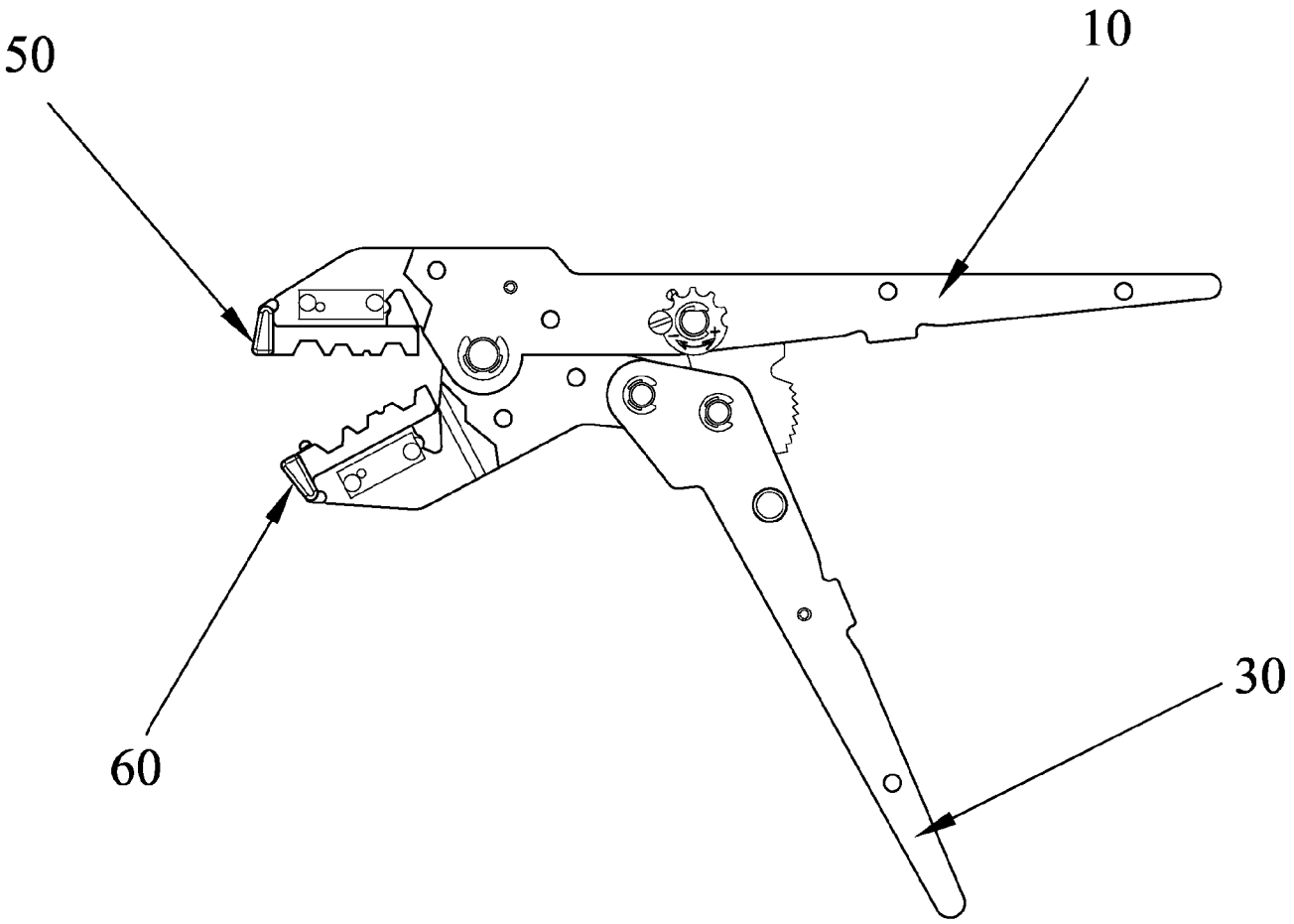
FIG. 18: Crimping tool when crimp head is in place.
Figure 19:
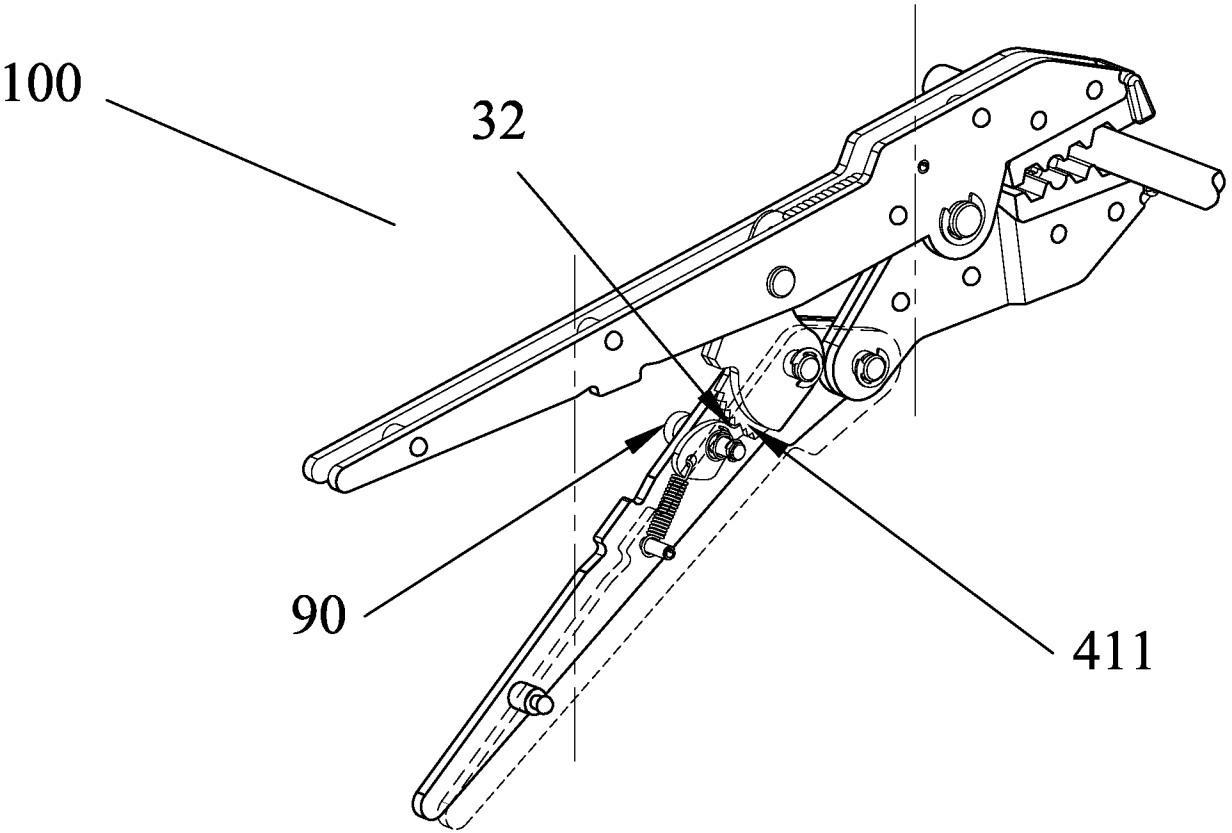
FIG. 19: Illustration of abnormal locked up.
Figure 20:
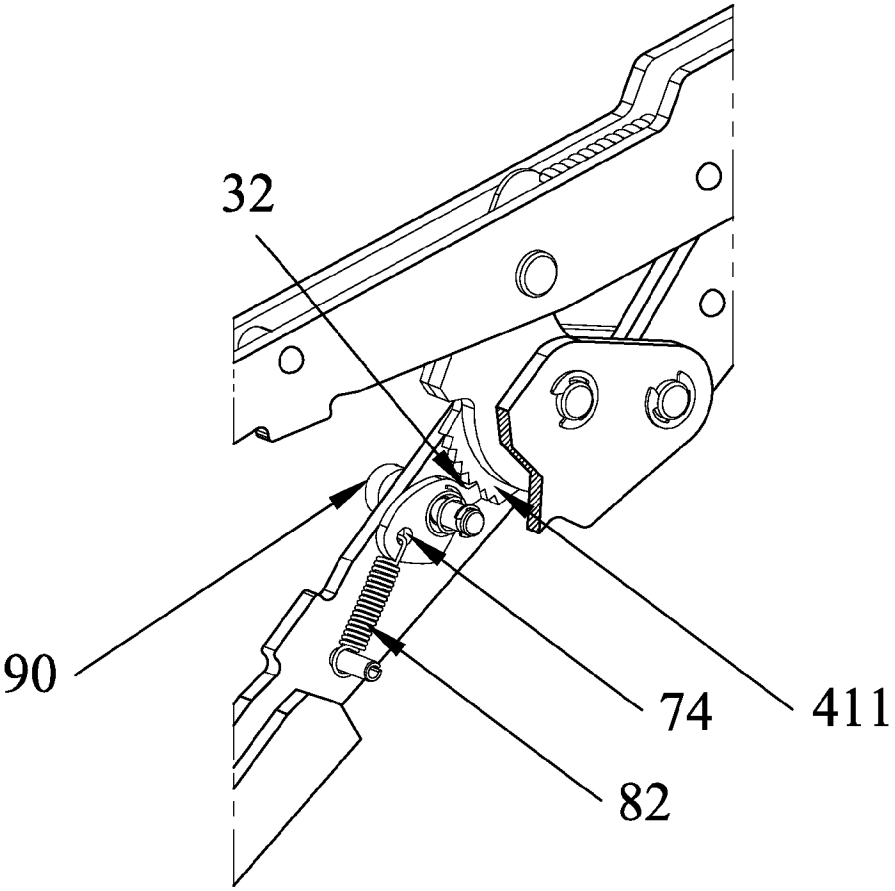
FIG. 20: Enlarged view of FIG. 19.
Figure 21:
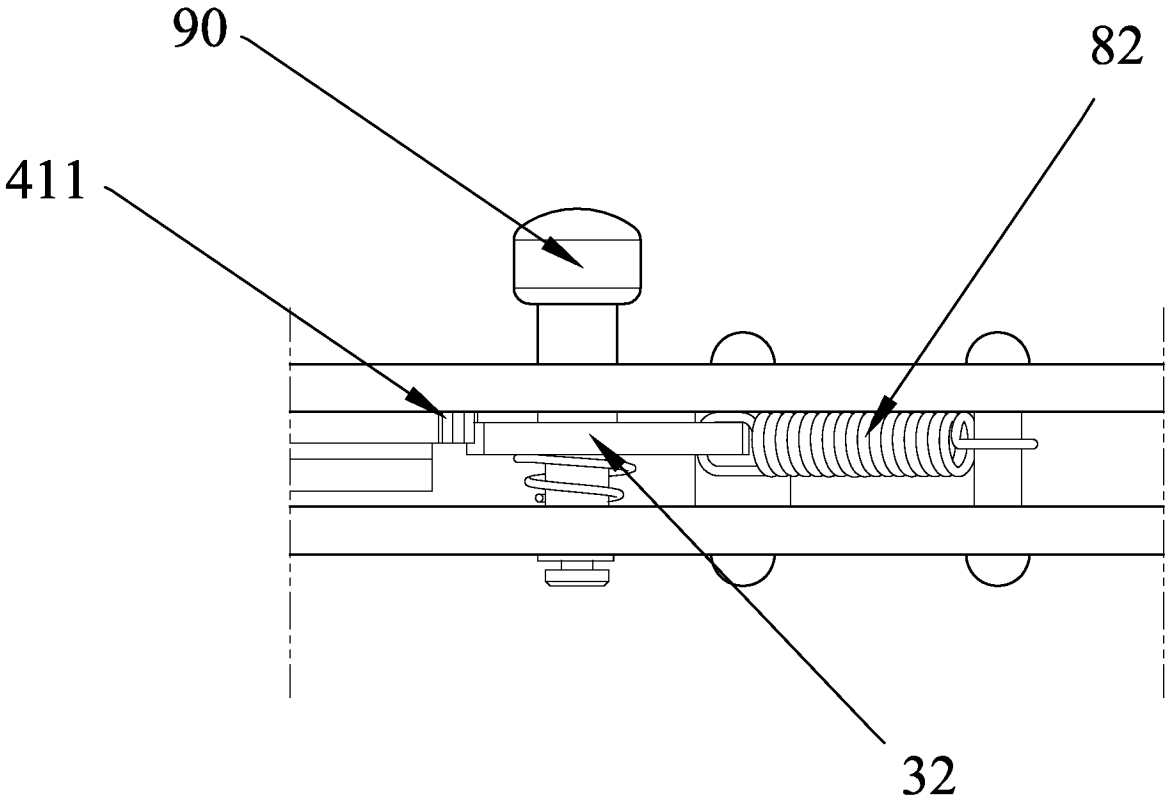
FIG. 21: Enlarged top view of FIG. 19.
Figure 22:
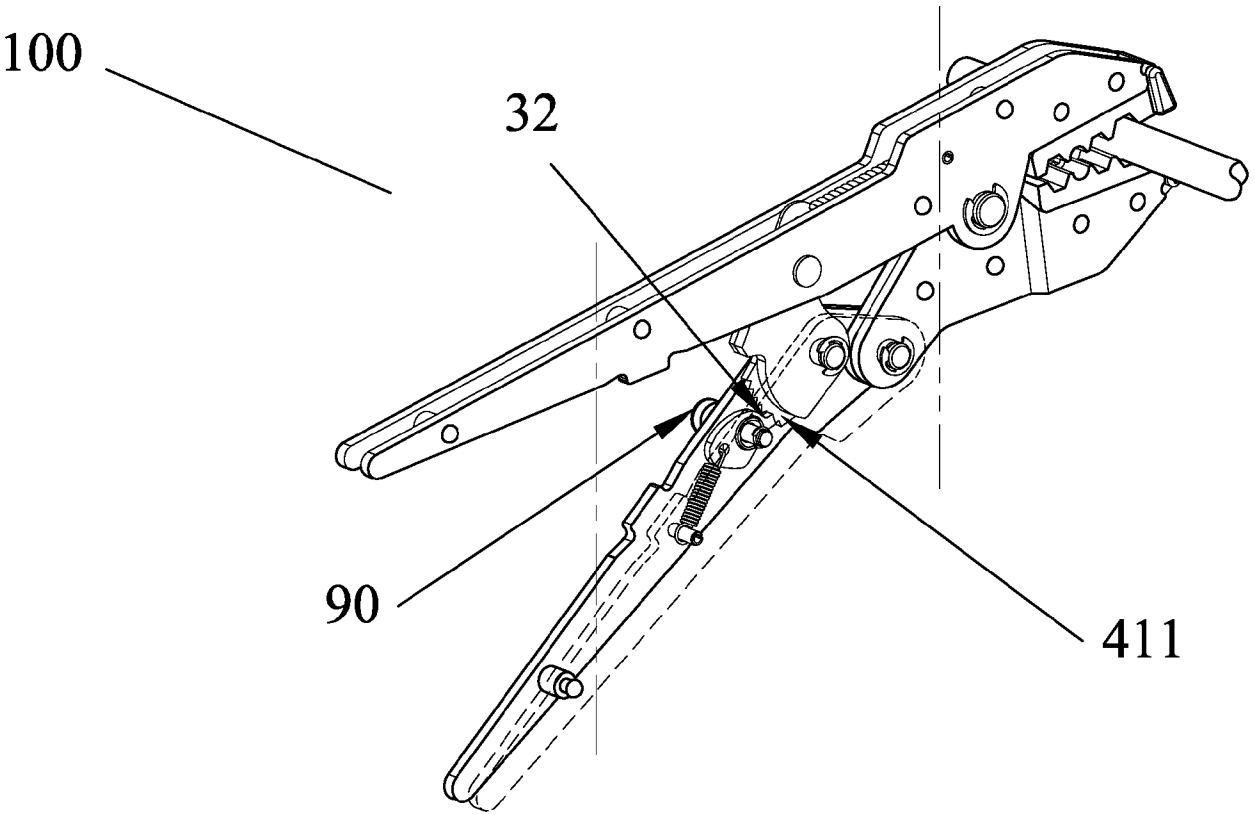
FIG. 22: Illustration of the release of an abnormally locked crimping tool.
Figure 23:
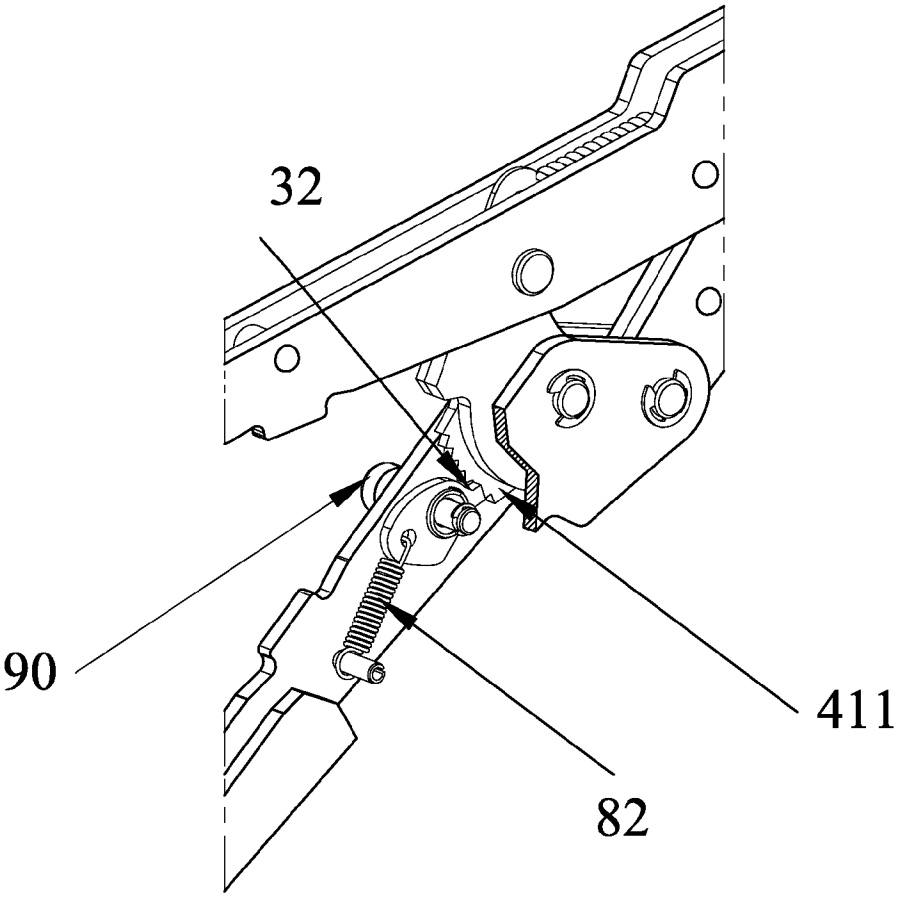
FIG. 23: Enlarged view of FIG. 22.
Figure 24:
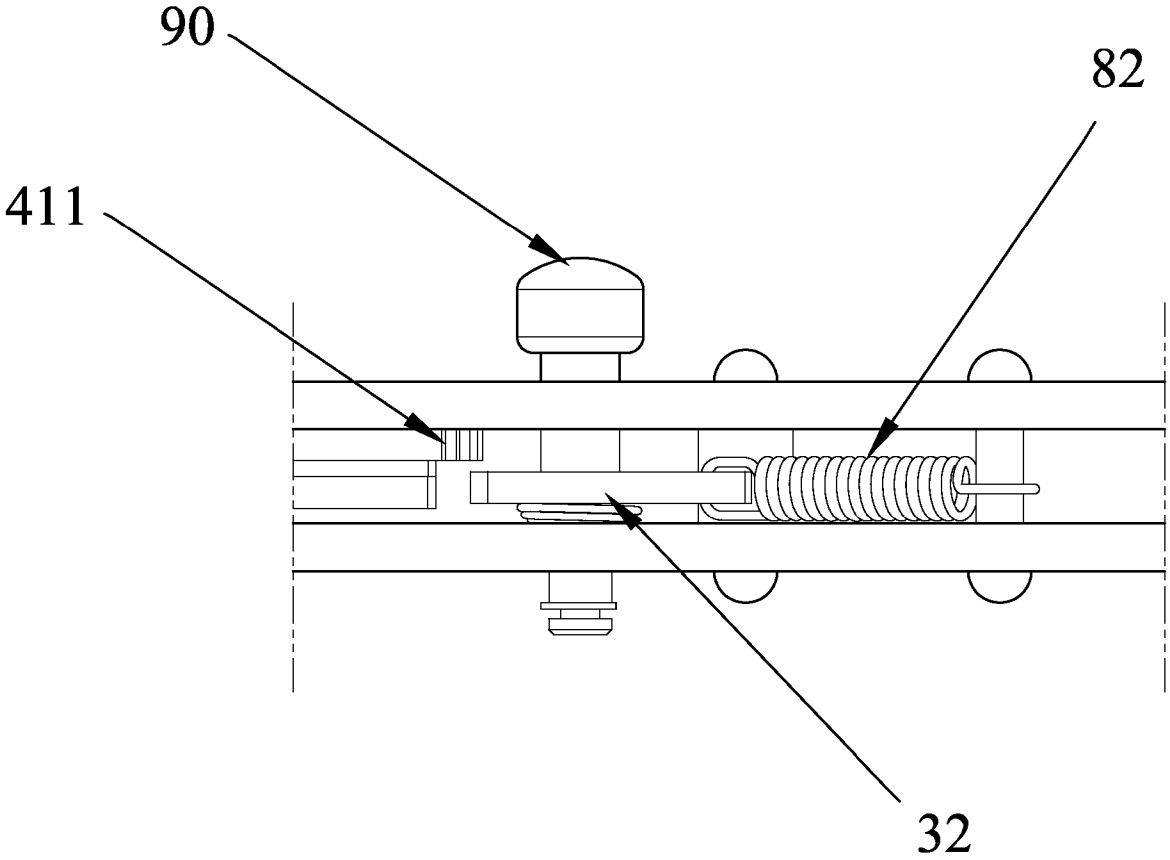
FIG. 24: Enlarged top view of FIG. 22.

Reverse the order from FIGS. 16 to 18, the crimp head 50 can be extracted from the first clamp section 11.

Because the first crimp head 50 is lodged at the first clamp section 11, therefore, the first crimp head 50 can be rapidly extracted and lodged, hence, replacement of the first crimp head 50 of various specifications can be done quickly.

Utilizing the second head 211A4 and the second crimp head notch 62 pushing each other combines with the second crimp head protrusion 61 and the second blocker back section notch 211B pushing each other to cause the second crimp head 60 to lodge at the second clamp section 21, this allows the second head 60 to lodge at the second clamp section 21.

Reverse the order from FIGS. 16 to 18, the second crimp head 60 can be extracted from the second clamp section 21.

Because the second crimp head 60 is lodged at the second clamp section 21, therefore, the second crimp head 60 can be rapidly extracted and lodged, hence, replacement of the second crimp head 60 of various specifications is done quickly.

Execution of releasing crimping tool due to abnormal locked up (according to FIGS. 19 to 24):

FIGS. 19 to 24 illustrate abnormal lock up and release of crimping tool 100.

During crimping tool 100 abnormal lock up, ratchet 411 and locking part 32 are abnormal meshed, crimping tool is rendered inoperable.

Resetting the crimping tool is done by depressing said push button 90, said push button 90 will move forward, said top section 91 of said push button 90 will push said rotation section 31 to compress said third return spring 83, said locking part 32 will now displace forward and situate at different plane relative to said ratchet 411 and will un-mesh with said ratchet 411, resulting in releasing said locked up crimping tool 100.

While this invention has been described in terms of preferred embodiments, those who are skilled in the art will recognize that this invention can be practiced with modifications within the spirit and scope of the appended claims.

What is claimed is:

1. A crimp head quick-change structure of a crimping tool that allows the crimping tool to rapidly replace its crimp head, the crimp head quick-change structure of a crimping tool comprising:

a first clamp handle which is pivotally connected to a second clamp handle, said first clamp handle comprises of: a first clamp section which equips with a first blocker front section and a first blocker back section notch, furthermore, the first blocker front section is setup adjacent to the first blocker back section notch;

said first blocker front section equips with a first fixed section, said first fixed section equips with a first elastic component and a first pusher, said first pusher equips with a first head, said first elastic component pushes said first pusher and causes said first head to protrude outside of said first fixed section; and a first crimp head which equips with a first crimp head protrusion and a first crimp head notch, said first crimp head protrusion is setup adjacent to said first crimp head notch;

therefore, utilizing said first crimp head protrusion and said first blocker back section notch pushing each other combines with said first crimp head notch and said first head pushing each other to cause said first crimp head to lodge at said first clamp section.

2. The crimp head quick-change structure of a crimping tool as defined in claim 1, wherein said second clamp handle is pivotally connected with a third clamp handle, said third clamp handle is pivotally connected with a fourth clamp handle, said fourth clamp handle is pivotally connected with said first clamp handle; said first clamp handle equips with a first hook bar, said fourth clamp handle equips with a fourth through hole, one end of a first return spring is attached to said first hook bar, and the other end of said first return spring is attached to said fourth through hole.

3. The crimp head quick-change structure of a crimping tool as defined in claim 2, wherein:

said fourth clamp handle equips with a ratchet block, said ratchet block equips with a ratchet; said third clamp handle equips with a first through hole, a third through hole, a second return spring, and a third return spring, one end of said second return spring attaches to said third clamp handle while the other end of said second return spring attaches to a fifth through hole of a rotation section, said rotation section is supported by said third return spring, said rotation section equips with a second through hole and a locking part, and said locking part is setup adjacent to said second through hole; and a push button which equips with a top section and a bottom section, said bottom section is setup adjacent to said top section, an annular groove is setup at said bottom section, said bottom section passes through said first through hole, then passes through said second through hole, then further passes said third return spring, after said bottom section passes through said third through hole, said annular groove will extend outside said third clamp handle and a C-ring is then buckled at said annular groove, because frontal projected area of said top section is larger than said frontal projected area of said first through hole, and said C-ring enables said push button and said third clamp handle is now rendered to be inseparable;

therefore, when said crimping tool is abnormally locked up, depresses said push button and causes said push button to displace forward, said top section of said push button pushes said rotation section to compress said third return spring, said locking part will now displace forward and situate at different plane relative to said ratchet and will un-mesh with said ratchet, resulting in releasing said locked up crimping tool.

4. The crimp head quick-change structure of a crimping tool as defined in claim 1, wherein said second clamp handle comprises: a second clamp section which equips with a second blocker front section and a second blocker back section notch, and said second blocker front section is setup next to said second blocker back section notch; and said second blocker front section equips with a second fixed section, said second fixed section equips with a second elastic component and a second pusher, said second pusher equips with a second head, and said second elastic component pushes said second pusher and causes said second head to protrude outside said second fixed section; and a second crimp head equips with a second crimp head protrusion and a second crimp head notch, and said second crimp head protrusion is setup next to said second crimp head notch;

therefore, utilizing said second crimp head protrusion and said second blocker back section notch pushing each other combines with said second crimp head notch and said second head pushing each other to cause said second crimp head to lodge at said second clamp section.

5. The crimp head quick-change structure of a crimping tool as defined in claim 4, wherein said second clamp handle is pivotally connected with a third clamp handle, said third clamp handle is pivotally connected with a fourth clamp handle, and said fourth clamp handle is pivotally connected with said first clamp handle; and said first clamp handle equips with a first hook bar, said fourth clamp handle equips with a fourth through hole, one end of a first return spring is attached to said first hook bar, and the other end of said first return spring is attached to said fourth through hole.

6. The crimp head quick-change structure of a crimping tool as defined in claim 5, wherein said fourth clamp handle equips with a ratchet block, and said ratchet block equips with a ratchet; said third clamp handle equips with a first through hole, a third through hole, a second return spring, and a third return spring, one end of said second return spring attaches to said third clamp handle while the other end of said second return spring attaches to a fifth through hole of a rotation section, said rotation section is supported by said third return spring, said rotation section equips with a second through hole and a locking part, and said locking part is setup adjacent to said second through hole; and a push button which equips with a top section and a bottom section, said bottom section is setup adjacent to said top section, an annular groove is setup at said bottom section, said bottom section passes through said first through hole, then passes through said second through hole, then further passes said third return spring, after said bottom section passes through said third through hole, said annular groove will extend outside said third clamp handle and a C-ring is then buckled at said annular groove, because frontal projected area of said top section is larger than said frontal projected area of said first through hole, and said C-ring enables said push button and said third clamp handle is now rendered to be inseparable;

therefore, when said crimping tool is abnormally locked up, depresses said push button and causes said push button to displace forward, said top section of said push button pushes said rotation section to compress said third return spring, said locking part will now displace forward and situate at different plane relative to said ratchet and will un-mesh with said ratchet, resulting in releasing said locked up crimping tool.

* * * * *